United States Patent [19]

Poole

[11] Patent Number: 4,722,826

[45] Date of Patent: Feb. 2, 1988

[54] PRODUCTION OF WATER ATOMIZED POWDER METALLURGY PRODUCTS

[75] Inventor: Jon M. Poole, Barboursville, W. Va.

[73] Assignee: Inco Alloys International, Inc., Huntington, W. Va.

[21] Appl. No.: 906,935

[22] Filed: Sep. 15, 1986

[51] Int. Cl.[4] ..... B22F 1/00

[52] U.S. Cl. ..... 419/11; 75/0.5 A; 75/0.5 AA; 75/232; 75/243; 264/5; 264/11; 419/19; 419/32; 419/36; 419/38; 419/40; 419/57; 419/58; 419/60

[58] Field of Search ..... 419/32, 36, 38, 40, 419/60, 11, 19, 57, 58; 264/5, 11; 75/0.5 A, 0.5 AA, 232, 243

[56] References Cited

U.S. PATENT DOCUMENTS

| | | | |
|---|---|---|---|
| 3,357,826 | 12/1967 | Honaker et al. | 75/206 |
| 3,811,878 | 5/1974 | Chao et al. | 75/211 |
| 3,846,126 | 11/1974 | Foley et al. | 75/211 |
| 3,889,350 | 6/1975 | Mocarski | 419/28 |
| 3,988,524 | 10/1976 | Dreyer et al. | 75/246 |
| 3,999,952 | 12/1976 | Kondo et al. | 419/12 |
| 4,062,678 | 12/1977 | Dreyer et al. | 419/41 |
| 4,113,480 | 9/1978 | Rivers | 75/214 |
| 4,129,444 | 12/1978 | Dreyer et al. | 419/10 |
| 4,373,970 | 2/1983 | Scorey et al. | 419/28 |
| 4,391,772 | 7/1983 | Bonnor et al. | 419/36 |
| 4,415,528 | 11/1983 | Wiech, Jr. | 419/46 |
| 4,478,790 | 10/1984 | Huther et al. | 419/54 |
| 4,626,406 | 12/1986 | Poole | 419/41 |

OTHER PUBLICATIONS

"Fabrication of Heat Exchanger Tubing of Powdered Metals", by John G. Thomas and Nicholas Maropis, Aeroprojects Incorporated, Mar. 1972, Research Report No. 72-6, Contract No. 14-30-2567 for U.S. Department of the Interior.

*Primary Examiner*—Stephen J. Lechert, Jr.

*Attorney, Agent, or Firm*—Raymond J. Kenny; Edward A. Steen

[57] ABSTRACT

A method for utilizing a powder metallurgy ("P/M") slurry by employing water atomized metallic powders and subsequently reducing the oxide levels therein to acceptable levels. The slurry comprises a carbon containing binder. The slurry is consolidated and sintered under controlled conditions to reduce the oxide levels.

19 Claims, 1 Drawing Figure

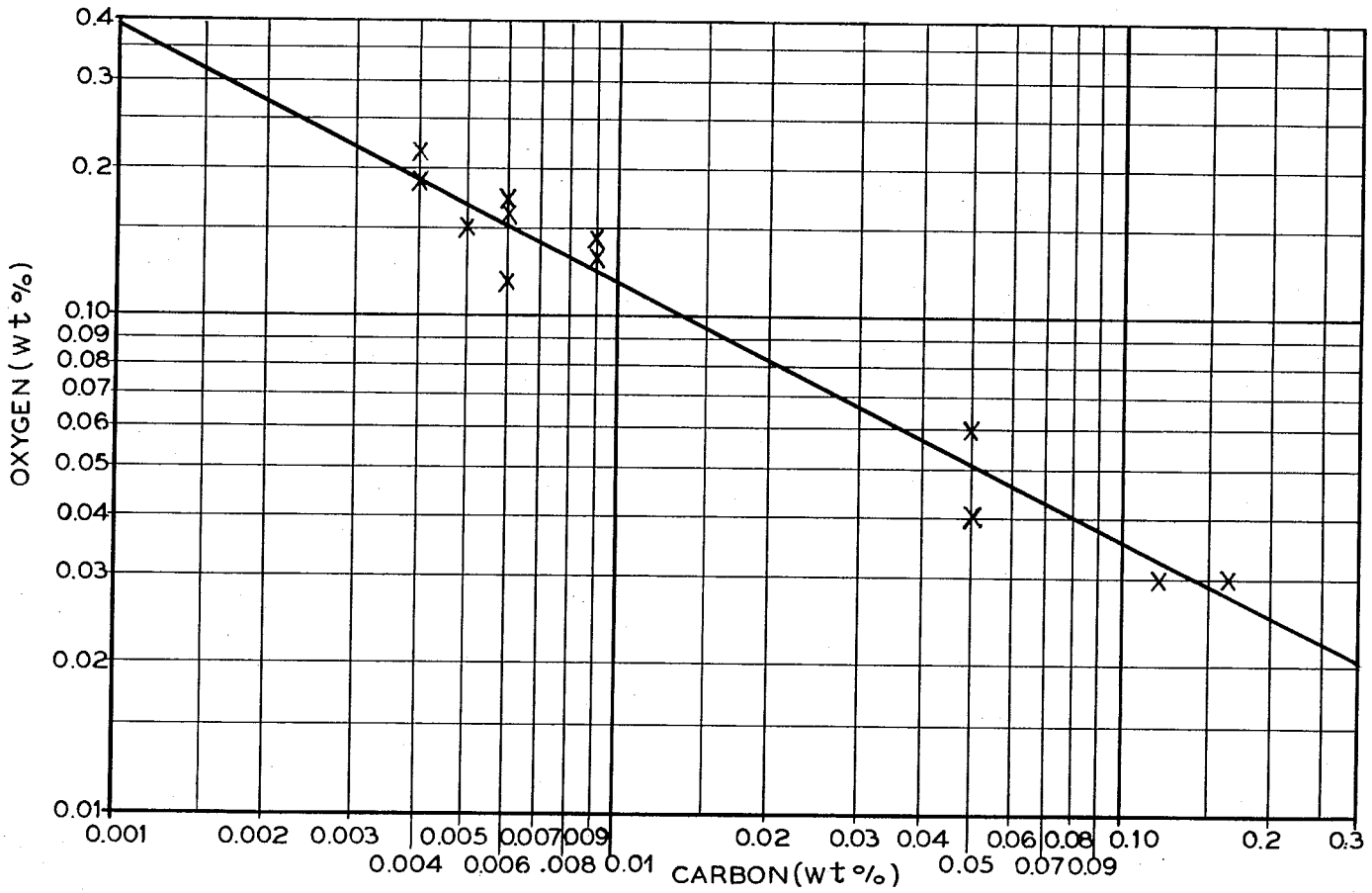
OXYGEN (Wt %)
0.4
0.3
0.2
0.10
0.09
0.08
0.07
0.06
0.05
0.04
0.03
0.02
0.01
CARBON (Wt %)
0.001
0.002
0.003
0.004
0.005
0.006
0.007
0.008
0.009
0.01
0.02
0.03
0.04
0.05
0.06
0.07
0.08
0.09
0.10
0.2
0.3

PRODUCTION OF WATER ATOMIZED POWDER METALLURGY PRODUCTS

TECHNICAL FIELD

The instant invention relates to powder metallurgy ("P/M") techniques in general and, more particularly, to a process for fabricating water atomized metallic powders into useful articles having relatively low oxide inclusions.

BACKGROUND ART

Superalloy powders are typically produced by inert atomization processes such as argon atomization, vacuum atomization, rotating electrode process and rotary disk atomization. Water atomization processes are usually unacceptable due to the formation of a heavy surface oxide produced by a chemical reaction of the form: $xMe+YH_2O=Me_xO_y+yH_2$. Reactive elements (Si, Al, Ti, Cr, Mn) are oxidized and are difficult to reduce in subsequent processing. Since oxides are detrimental to the product's mechanical properties inert atomization processes (oxygen<200 ppm) are used.

Unfortunately, inert atomization processes produce spherical powders which are not satisfactory for standard die compaction processes. These powders require special consolidation practices such as HIP, Cercon, CAP, etc. which are rather expensive. Due to costs of gas atomization and consolidation, the use of powder metallurgy for superalloy production has been limited to aerospace applications where the expense is justified.

There is a need for a superalloy powder that can be die compacted using existing technology. Such a powder should have an irregular shape, small average particle size and relatively low oxygen content (about 200 ppm). Water atomization can produce the irregular powder, but the oxygen content is too large. If the oxides can be removed in a cost effective process, these powders would be commercially attractive. In the steel industry, some strides are being made to satisfy these requirements. Stainless steel powders (304L, 316L, 410 and 430 grades) containing Cr and/or Mn are available and are being used to lower the cost and improve the hardenability of the finished product. These powders are produced by water atomization under conditions that minimize the oxygen level (oxygen<1550 ppm). Some of these parameters are an inert purge of the atomization chamber, lower silicon heats, use of soft water (low calcium), and minimizing liquid turbulence during melting to reduce slag impurities. Further, during processing a high temperature sintering operation is used with careful control of dew point and carbon reduction to remove any oxides. In another related process (QMP), tool steels are made from water atomized powders by producing a high carbon heat. During the sintering operation a self-generated $CO$-$CO_2$ atmosphere reduces the oxygen content.

In particular, the P/M slurry method is a process whereby a water soluble binder is mixed with a water atomized metal powder, lubricants and modifiers to a clay-like consistency. It is subsequently extruded or injected molded to some shape and allowed to dry so it can be handled. The product is sintered and consolidated (i.e., HIP, Cercon, hot or cold forming, etc.) with the result being near fully dense product. This method is also amenable to injection molding (U.S. Pat. No. 4,113,480) as well as die compaction (U.S. Pat. Nos. 3,988,524 and 4,129,444).

The P/M slurry method has been examined by other researchers. Firstly, in a study by Aeroprojects under contract by the U.S. Department of Interior (14-30-2567), it was determined that slurry extrusion of elemental powders (copper and nickel) was a feasible production method for fabrication of heat exchanger tubing. U.S. Pat. No. 4,113,480 deals with the production of powder parts by injection molding of inert gas atomized, very fine (10 micron) powder. As far as is known, no work has been accomplished on the use of water atomized powders due to the tenacious surface oxides.

SUMMARY OF THE INVENTION

Accordingly, there is provided a method for water atomizing metallic powders and subsequently reducing the oxide levels therein to acceptable levels. By utilizing a P/M slurry method the ultimate product has useful and desirable properties.

In essence, water atomized metallic powder is blended with a carbon containing binder and processing aids to form a slurry. The slurry is consolidated and the binder removed. The consolidate is then sintered under controlled conditions to create suitable strength and cause deoxidation therein. The product may be then decarburized.

BRIEF DESCRIPTION OF THE DRAWING

The FIGURE is a graphical relationship between carbon and oxygen levels for the sintered alloy.

PREFERRED MODE FOR CARRYING OUT THE INVENTION

All powder samples were fabricated using a P/M slurry process. The process, for discussion purposes, may be divided into four categories (1) Powder Preparation; (2) Consolidation; (3) Sintering; and (4) Evaluation.

1. Powder Preparation

Water atomized alloy 825 heat number 1 was used throughout this study. The chemistry of this heat along with some results on argon atomized powders for comparison are given in Table 1. Conventional atomizing equipment was utilized. Note the high oxygen (3800 ppm) and nitrogen (800 ppm) content as compared to the argon atomized powders (oxygen<300 ppm, nitrogen<100 ppm). Average size of the water atomized powders was 50 μm whereas argon atomized powder was about 70–100 μm. These figures will vary somewhat depending on the atomizing conditions.

2. Consolidation

The dried powder was blended with 3% (by weight) Natrosol (a trademark) and 15% water (by weight) in a mixer to form a viscous slurry. Natrosol is a water soluble, ethylcellulose binder. The slurry was subsequently cold extruded to 0.280 inch diameter (0.71 cm) and allowed to air dry for twenty four hours to a hard, brittle piece which was able to be handled.

3. Sintering

A Burrell (trademark) high temperature electric furnace with a ceramic muffle and continuous atmosphere flow was used for all heat treating. The dried slurry rod received a two step heat treatment consisting of a binder burnout at 900° F. (482° C.) and sinter at 2400° F. (1315° C.). Variables investigated in the sintering operation included the burnout atmosphere (nitrogen, argon or hydrogen), burnout time 1.0 hr or 4.0 hr) and sinter atmosphere (argon or hydrogen). Hydrogen dew point was estimated to be below −20° F. (−28° C.) for all operations. Sintering time was four hours and the material was muffle cooled under nitrogen before removal from the furnace. Atmosphere flow rate was held constant at 4 scf/min. (0.002 $m^3/s$).

4. Evaluation

Evaluation consisted of density determination, chemical analysis (oxygen, nitrogen, carbon and sulfur), and metallographic analysis. Density measurement was based on weight and piece dimensions. This method is admittedly not very precise, but there is no other acceptable procedure for very porous materials. Estimated error on density calculations was 5%.

The results are given in Table 2 and in the FIGURE which shows the relationship (in weight percent) between oxygen and carbon for sintered alloy 825 at 900° C.) 1 hour+2400° F. (1315° C.) 4 hours $N_2$, Ar and/or $H_2$ sintering atmosphere.

Inspection of the data revealed that the carbon present in the binder reduced the surface oxides by the reaction:

$$M_xO_y+(y)C\rightarrow(x)M+(y)CO$$

Here M represents a metal or combination of metals (such as Ni, Cr, Fe, Ti, Si or Mo) that is present as an oxide. Should the oxide be substantially $Cr_2O_3$ (as in the case of alloy 825) the reaction is thermodynamically feasible above 2296° F. (1258° C.) at one atmosphere CO pressure, hence the oxide reduction occurs near the sintering temperature. At lower CO partial pressures, the reaction temperature is reduced below the sintering temperature which, in turn, reduces the probability of oxide entrapment. The main point is to maintain a low CO partial pressure by strict atmospheric control. A nitrogen atmosphere is undesirable due to excessive nitriding. Only an inert (pure argon or helium) or vacuum with an inert backfill atmosphere is desired. A hydrogen atmosphere will result in decarburization rather than deoxidization. However, after deoxidization, the carbon content can be reduced by the use of a low dew point hydrogen atmosphere.

It is recognized that the level of oxygen here has been reduced from 3800 ppm to 300 ppm which is still higher than inert gas atomized products (100 ppm). This is due to the fact that only about 90% of the oxygen in the water atomized powders is on the surface. In this case about 300 ppm oxygen is internal (as oxides or solution) and is not available for reaction. Hence the product formed here will not be of identical quality with a product produced from gas atomized powder. However, the quality is acceptable for many applications and the cost savings may be attractive.

Since the major reactive element in alloy 825 is chromium, it is assumed that the surface oxide is predominately $Cr_2O_3$. Using a flowing inert argon atmosphere, with the carbon supplied by the binder, reduction of the oxide is possible due to the reaction:

(1) $3C(s)+Cr_2O_3(s)\rightarrow 3CO(g)+2Cr(s)$ (2) $\Delta G^\circ_T=191{,}020-124.76T=-4.575\ \mathrm{Log}\ [P_{\underline{co}}{}^3]$ (3) Total Pressure

TABLE I

| | Chemistry (wt %) of as Atomized alloy 825 Powders | | | | | | | | | | | | | | | |
|---|---|---|---|---|---|---|---|---|---|---|---|---|---|---|---|---|
| Heat No. | C | Mn | Fe | S | Si | Cu | Ni | Cr | Al | Ti | Mo | Cb + Ta | P | O | N | B |
| 1 | 0.046 | 0.015 | 29.29 | 0.0017 | 0.07 | 1.73 | 42.05 | 22.41 | 0.0046 | 0.40 | 3.08 | 0.02 | 0.0014 | 0.38 | 0.08 | 0.003 |
| 2 | 0.010 | 0.01 | 29.51 | 0.002 | 0.05 | 1.45 | 42.20 | 22.73 | 0.02 | 0.72 | 3.05 | 0.01 | 0.001 | 0.018 | 0.003 | 0.003 |
| 3 | 0.020 | 0.47 | 37.64 | 0.002 | 0.05 | 2.32 | 27.81 | 26.15 | 0.09 | 1.01 | 3.98 | 0.03 | 0.003 | 0.013 | 0.006 | 0.001 |
| 4 | 0.008 | 0.30 | 39.20 | 0.003 | 0.06 | 1.90 | 26.0 | 27.5 | 0.10 | 0.99 | 4.03 | 0.03 | — | 0.030 | 0.010 | — |

Notes:
(1) Heat 1 is water atomized powder, others are argon atomized powder included for comparison.
(2) Heats 3 and 4 are out of definition for alloy 825 chemistry.

TABLE 2

| Binder Burnout Atmosphere | Hydrogen Sintering Atmosphere | | | | Argon Sintering Atmosphere | | | |
|---|---|---|---|---|---|---|---|---|
| | Heat Treat A | | Heat Treat B | | Heat Treat A | | Heat Treat B | |
| | Run 1 | Run 2 | Run 1 | Run 2 | Run 1 | Run 2 | Run 1 | Run 2 |
| $N_2$ | 4.94 g/cc | 4.91 g/cc | 5.30 g/cc | 4.91 g/cc | 4.77 g/cc | 4.79 g/cc | 4.62 g/cc | 4.49 g/cc |
| | 0.15% $O_2$ | 0.16% $O_2$ | 0.12% $O_2$ | 0.15% $O_2$ | 0.040% $O_2$ | 0.04% $O_2$ | 0.06% $O_2$ | 0.06% $O_2$ |
| | 0.02% $N_2$ | 0.016% $N_2$ | 0.05% $N_2$ | 0.016% $N_2$ | 0.10% $N_2$ | 0.08% N | 0.10% $N_2$ | 0.08 N |
| | — | 0.006% C | — | 0.005% C | — | 0.05% C | — | 0.05% C |
| | — | 0.0006% S | — | 0.0006% S | — | 0.001% S | — | 0.001% S |
| $H_2$ | 5.61 g/cc | 5.06 g/cc | 4.83 g/cc | 4.83 g/cc | 4.43 g/cc | 4.36 g/cc | 4.06 g/cc | 4.54 g/cc |
| | 0.13% O | 0.12% O | 0.16% $O_2$ | 0.21% O | 0.08% $O_2$ | 0.13% $O_2$ | 0.24% $O_2$ | 0.14% $O_2$ |
| | 0.05% $N_2$ | 0.043% N | 0.03% $N_2$ | 0.011% $N_2$ | 0.05% $N_2$ | 0.06% $N_2$ | 0.04% $N_2$ | 0.06% $N_2$ |
| | — | 0.006% C | — | 0.004% C | — | 0.009% C | — | 0.009% C |
| | — | 0.006% S | — | 0.006% S | — | 0.0006% S | — | 0.006% S |
| Ar | 5.40 g/cc | 5.31 g/cc | 5.94 g/cc | 4.88 g/cc | 5.07 g/cc | 5.17 g/cc | 4.20 g/cc | 5.01 g/cc |
| | 0.08% $O_2$ | 0.19% O | 0.17% $O_2$ | 0.17% $O_2$ | 0.04% $O_2$ | 0.03% $O_2$ | 0.11% $O_2$ | 0.03% $O_2$ |
| | 0.09% $N_2$ | 0.006% $N_2$ | 0.01% $N_2$ | 0.013% $N_2$ | 0.06% $N_2$ | 0.07% N | 0.06% $N_2$ | 0.08% N |
| | — | 0.004% C | — | 0.006% C | — | 0.16% C | — | 0.12% C |
| | — | 0.001% S | — | 0.0006% S | — | 0.008% S | — | 0.008% S |

Notes:
(1) Heat Treat A - 900° F. (482° C.) 1 hr. ($H_2$, $N_2$ or Ar) MC + 2400° F. (1315° C.) 4 hr ($H_2$ or Ar) MC
Heat Treat B - 900° F. (482° C.) 4 hr. ($H_2$, $N_2$ or Ar) MC + 2400° F. (1315° C.) 4 hr ($H_2$ or Ar) MC
(2) Binder burnout is conducted at 900° F. (482° C.) and sintering at 2400° F. (1315° C.)
(3) Given is the sintered density (in grams per cubic centimeter) and the as sintered chemical analysis (oxygen, nitrogen, carbon and sulfur).
MC = Muffle Cool $=1$ atm.

$=$Partial Pressure CO$+$Partial Pressure Sinter Atmosphere

Here $\Delta G^\circ_T$ is the standard Gibbs Free Energy as a function of temperature (degrees Kelvin) for the reaction. When $\Delta G^\circ_T$ is negative the reaction will proceed to the right, if $\Delta G^\circ_T$ is zero the reaction is at equilibrium. The equilibrium temperature for the reaction is related to the partial pressure ($P_{CO}$) of the carbon monoxide gas: (a) $P_{CO}=1$ atm, Equilibrium temp.$=2296°$ F. (1258° C.), (b) $P_{CO}=0.1$ atm, Equilibrium temp.$=2022°$ F. (1106° C.) and (c) $P_{CO}=0.01$ atm, Equilibrium temp.$=1800°$ F. (982° C.). Since the major portion of the atmosphere is inert argon, the partial pressure of carbon monoxide is low and the reaction of $Cr_2O_3$ is possible well below the sintering range of the material (above 2200° F. [1204° C.]). This is important as oxide reduction should occur below any oxides are trapped by the sintering operation. An ideal situation would be to vacuum treat the material and monitor the gas partial pressures to determine when the reaction reaches equilibrium.

With the hydrogen atmosphere (dew point estimated below $-20°$ F. [$-28°$ C.]), the situation is complicated. Possible reactions include:

(4) $C(s)+2H_2 \rightarrow CH_4(g)$ (5) $\Delta G^\circ_T=-21{,}550+26.16T$ (6) $H_2O(g)+C(s) \rightarrow H_2(g)+CO(g)$ (7) $\Delta G^\circ_T=58850-13.12T$ (8) $Me_xO_y+YH_2(g) \rightarrow YH_2O+xMe$ All three reactors may occur at some time depending on the temperature, atmosphere dew point, atmosphere composition and the hydrogen-binder system interaction. The overall effect should be complete binder burn-off (decarburize) and oxide reduction at or near the sintering atmosphere.

Another consideration is the formation of carbides by the reaction:

(6) $XMe(s)+YC(s) \rightarrow Me_xC_y$ (7) $\Delta G^\circ_T<O$ all temperatures Any unreacted carbon in contact with a potent carbide former (i.e., Cr, Ti) may form a carbide at the powder interface which is expected to hinder the sintering process. The key will be to stop the oxide reduction process by changing to a decarburizing atmosphere to prevent any excessive carbide formation, or minimize the amount of the carbon addition to the material in order to only reduce the oxides.

In summary, this invention deals with oxide removal from ferrous and non-ferrous products containing chromium and lesser amounts of aluminum, titanium, silicon, magnesium, manganese and other difficult-to-reduce oxides. Substantial amounts of additional difficult-to-reduce oxides (such as aluminum) are beyond the scope of the present invention as they cannot be reduced by carbon except at extremely high temperatures. This invention also recognizes that the carbon reactant is from the binder (additions of carbon to augment the binder are contemplated). Here, the intent is not only to reduce the surface oxides, but the form a product as well. After the sintering operation, the product can be consolidated to near full density by conventional consolidation and heat treating operations.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property of privilege is claimed are defined as follows:

1. A P/M method for producing workpieces, the method comprising:

(a) water atomizing a metallic alloy system, to form a metallic powder, (b) blending the water atomized metallic powder with water and a water soluble binder having sufficient carbon therein to reduce oxides present in the powder to a predetermined level upon sintering, (c) consolidating the powder/water/binder mixture to a desired workpiece configuration, (d) removing the binder, (e) sintering the workpiece in an inert atmosphere or vacuum at a temperature at or above which the carbon in the binder reduces the oxides in the powder/binder and at a carbon monoxide partial pressure up to and including one atmosphere.

2. The method according to claim 1 wherein the metallic alloy system includes a nickel-base alloy.

3. The method according to claim 1 wherein the partial pressure of carbon monoxide is reduced to cause oxide reduction of a temperature below the sintering temperature.

4. The method according to claim 1 wherein when chromium oxide is present in the metallic powder, the sintering step above is conducted above about 1258° C.

5. The method according to claim 1 wherein the binder includes ethylcellulose.

6. The method according to claim 1 wherein additional carbon is added to the metallic powder.

7. The method according to claim 1 wherein the metallic powder includes about 38–46% nickel, about 19.5%–23.5% chromium, about 2.5–3.5% molybdenum, about 1.5–3.0% copper, about 0.6–1.2% titanium, up to about 1.0% manganese, the balance iron and impurities.

8. The method according to claim 1 wherein the sintering atmosphere is selected from the group consisting of argon and helium.

9. The method according to claim 1 wherein the workpiece is decarburized.

10. The method according to claim 9 wherein the workpiece is decarburized in a low dew point hydrogen atmosphere.

11. A method of fabricating nickel-base alloy forms, the method comprising:

(a) water atomizing a nickel-base alloy system to form a powder, (b) blending the powder with a water soluble binder and water to form a slurry having sufficient carbon therein to reduce oxides present in the powder to a predetermined level upon sintering, (c) consolidating the slurry into a form, (d) removing the binder, (e) sintering the form in an inert atmosphere or vacuum at a temperature at or above which the carbon in the binder reduces the oxides in the slurry and at a carbon monoxide partial pressure up to and including one atmosphere.

12. The method according the claim 11 wherein the partial pressure of the carbon monoxide is reduced to cause oxide reduction at a temperature below the sintering temperature.

13. The method according to claim 11 wherein when chromium oxide is present in the powder, the sintering step above is conducted above 1232° C.

14. The method according to claim 11 wherein the binder includes ethylcellulose.

15. The method according to claim 11 wherein additional carbon is added to the slurry.

16. The method according to claim 11 wherein the form is decarburized.

17. The method according to claim 11 wherein the sintering atmosphere is selected from the group consisting of argon and helium.

18. The method according to claim 11 wherein the form is decarburized.

19. The method according to claim 18 wherein the form is decarburized in a low dew point hydrogen atmosphere.

* * * * *